US007156972B2

(12) United States Patent
Diel et al.

(10) Patent No.: US 7,156,972 B2
(45) Date of Patent: Jan. 2, 2007

(54) METHOD FOR CONTROLLING THE FERRIC ION CONTENT OF A PLATING BATH CONTAINING IRON

(75) Inventors: Wolfgang Diel, Wiesbaden (DE); Richard M. Peekema, San Jose, CA (US); Murali Ramasubramanian, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 525 days.

(21) Appl. No.: 10/427,232

(22) Filed: Apr. 30, 2003

(65) Prior Publication Data

US 2004/0217007 A1 Nov. 4, 2004

(51) Int. Cl.
*C25D 21/06* (2006.01)
*C25D 21/18* (2006.01)

(52) U.S. Cl. ..... 205/98; 205/99; 205/101

(58) Field of Classification Search ..... 205/98, 205/99, 101
See application file for complete search history.

(56) References Cited

U.S. PATENT DOCUMENTS 3,103,474 A * 9/1963 Juda ..... 205/554
4,159,366 A * 6/1979 Thaller ..... 429/15
5,683,568 A 11/1997 Harris et al. ..... 205/259
5,883,762 A 3/1999 Calhoun et al. ..... 360/113
5,932,082 A 8/1999 Harris et al. ..... 205/259
6,344,128 B1 2/2002 Toledo et al. ..... 205/260

FOREIGN PATENT DOCUMENTS

JP 02019500 A * 1/1990

OTHER PUBLICATIONS

Peekema, "Potentiostatic Control of Ferric Ion in a Permalloy Plating Bath", Proceedings—Electrochem. Soc. (no month, 1988), 88-23 (Proc. Symp. Electrochem. Technol. Electron., 1987), pp. 553-559.*

* cited by examiner

*Primary Examiner*—Edna Wong
(74) *Attorney, Agent, or Firm*—Zilka-Kotab, PC

(57) ABSTRACT

A system and method for reducing ferric ion content in a plating solution by exposing hydrogen to an electrode in a plating solution for reducing a ferric ion content in the plating solution.

23 Claims, 4 Drawing Sheets

METHOD FOR CONTROLLING THE FERRIC ION CONTENT OF A PLATING BATH CONTAINING IRON

FIELD OF THE INVENTION

The present invention relates to magnetic head fabrication, and more particularly, this invention relates to reducing harmful elements in a plating bath.

BACKGROUND OF THE INVENTION

Electroplating is a common process for depositing a thin film of metal or alloy on a workpiece article such as various electronic components for example. In electroplating, the article is placed in a suitable electrolyte bath containing ions of a metal to be deposited. The article forms a cathode, which is connected to the negative terminal of a power supply, and a suitable anode is connected to the positive terminal of the power supply. Electrical current flows between the anode and cathode through the electrolyte, and metal is deposited on the article by an electrochemical reaction.

Electroplating is widely used in the thin film head industry to fabricate magnetic and non-magnetic materials that constitute the writing part of a read-write head. Magnetic materials with Nickel and Iron are widely used as the write pole (and read shield) materials in thin film heads. Different compositions of nickel and iron provide different properties and hence are suitable for different applications. Other plating materials include cobalt-iron compositions.

During plating, it is desirable to obtain the purest volume of magnetic material possible. If impurities such as iron hydroxide or iron oxide are present during plating, the purity of the resulting magnetic material is reduced, with a resulting reduction in the maximum flux obtainable.

The current state of the art has shifted towards material with a high iron content and the resulting high magnetic moment. To raise the iron content in the deposit, however, more iron must be used in the plating solution. More iron in the bath means more ferric ions ($Fe^{3+}$). The ferric ion content of plating baths containing iron can adversely influence both the rate and nature of the metal deposits.

Ferric ions are created by oxidation of ferrous iron ($Fe^{2+}$) in the plating solution. For example, air oxidation of the ferrous iron results in a continuing buildup of ferric ion in the plating solution. Ferrous ions can also react with dissolved oxygen in the plating solution to form ferric ions.

Ferric ions are harmful in that they can form iron hydroxide or iron oxide, which precipitates as particulate matter. Particulate matter, as known to those skilled in the art, affects the purity of the plating deposits, and thus its magnetic characteristics.

Ferric ions also affect the rate of plating. Ferric ions react with electrons at the wafer surface and return (are reduced) to ferrous ions. This consumes power, reducing current efficiency. The result is inconsistent quality and quantity, as the amount of electrons consumed for this side reaction will vary with the concentration of $Fe^{3+}$ in the bath. For example, assume the plating bath is used regularly on a daily basis, but is left idle for a period of time. A high level of $Fe^{3+}$ will have formed over the idle period due to the prolonged exposure of the plating solution to air and lack of electrolytic reduction of $Fe^{3+}$. Thus, the level of $Fe^{3+}$ when plating is resumed will be much higher than the level at which plating was discontinued. Consequently, the current efficiency changes with idle time due to the variation in current being used up for ferric reduction. When $Fe^{3+}$ reduces on the wafer surface, products of the reaction may become incorporated in the wafer structure. In addition, when plating Ni and Fe, ferric hydroxide particles are suspended in the plating solution. Those can also get incorporated, which rapidly reduces magnetic film quality.

The prior art has made many attempts to control the ferric content in plating solutions. The usual practice is to allow the ferric to build up until it precipitates. The precipitate is continuously collected on a sub-micron filter through which the plating solution is circulated. One disadvantage of this approach is that the filter quickly becomes clogged. Further, the ferric ion content is always high, i.e., at saturation, and thus the problems mentioned above remain present.

Another practice is to introduce a completion agent to keep the ferric ions in soluble form, and avoid precipitation. One drawback to this method is that the ferric content continues to build up over time, resulting in an increase in ferric ion reaction on the wafer. The current efficiency and therefore the plating rate thus decrease over time.

Another practice used to mitigate the ferric problem is to blanket the bath with nitrogen to prevent the air oxidation of the ferrous ions. This is not completely successful, because the bath is circulated out to plating cells which cannot conveniently be operated under a nitrogen blanket.

The potentiostatic reduction of the ferric has also been employed, but it requires complex instrumentation including a reference electrode, and a sacrificial anode which will not cause the oxidation of ferrous ions to ferric ions.

What is therefore needed is a way to not only reduce the ferric ion content in a plating bath, but also a way to do so efficiently.

SUMMARY OF THE INVENTION

The present invention solves the problems described above by providing a system and method for reducing ferric ion content in a plating solution by exposing hydrogen to an electrode in a plating solution for reducing a ferric ion content in the plating solution.

Preferably, the electrode has a platinum surface, and can be constructed of a platinized titanium electrode. The electrode can be positioned in a plating reservoir, in a plating cell, and/or in a filter housing. The hydrogen can be bubbled over the electrode and/or can be added to the plating solution such that it dissolves into the plating solution. The circulation of the plating solution near the electrode can be increased to increase efficiency.

According to another embodiment, an electrode with a platinum surface, and positioned in a plating solution having a partial iron content, is energized. Hydrogen is exposed to the electrode.

A system for plating according to one embodiment includes a plating cell containing plating solution for plating iron to a substrate and a plating reservoir for storing plating solution. Piping fluidly connects the plating cell and plating reservoir. A hydrogen electrode is in contact with the plating solution, where the electrode is positioned in at least one of the plating cell, the plating reservoir, and the piping.

According to yet another embodiment, a method for plating includes immersing a substrate in a bath of plating solution and initiating an electrodeposition operation for depositing a layer of material on the substrate. The electrodeposition operation includes agitating the bath and applying current to the substrate. Hydrogen is exposed to an electrode in the plating solution for reducing a ferric ion content in the plating solution.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

BEST MODE FOR CARRYING OUT THE INVENTION

The following description is the best embodiment presently contemplated for carrying out the present invention. This description is made for the purpose of illustrating the general principles of the present invention and is not meant to limit the inventive concepts claimed herein.

Figure 1:
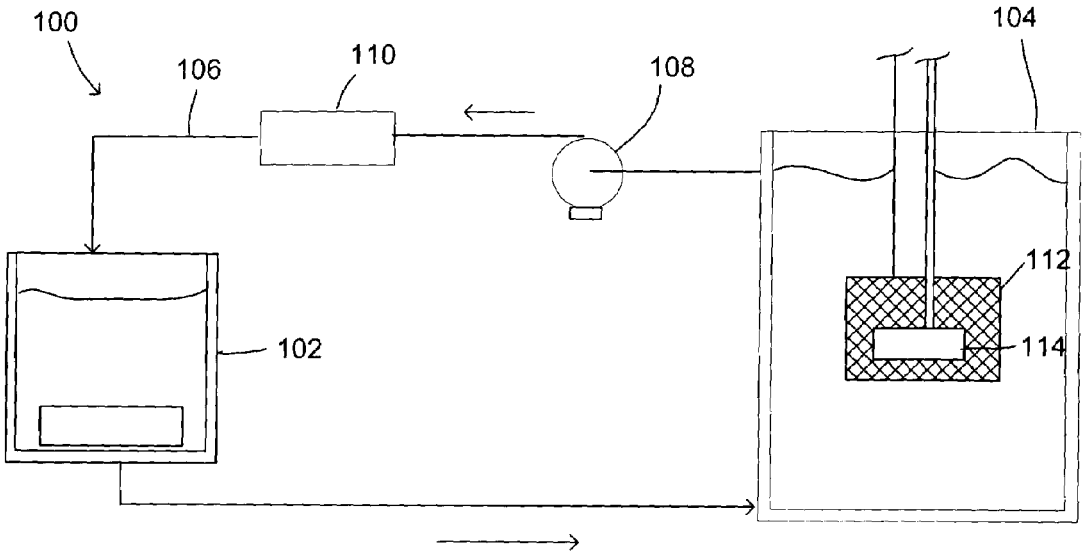
FIG. 1 is a cross sectional system diagram of a plating system according to one embodiment.

FIG. 1 illustrates a plating system 100 according to an illustrative embodiment of the present invention. As shown, the system 100 includes a plating cell 102, a plating reservoir 104, and a piping system 106 with a pump(s) 108. A filter 110 for removing particulate matter may also be included somewhere in the system 100, such as in the piping system 106.

Figure 2:
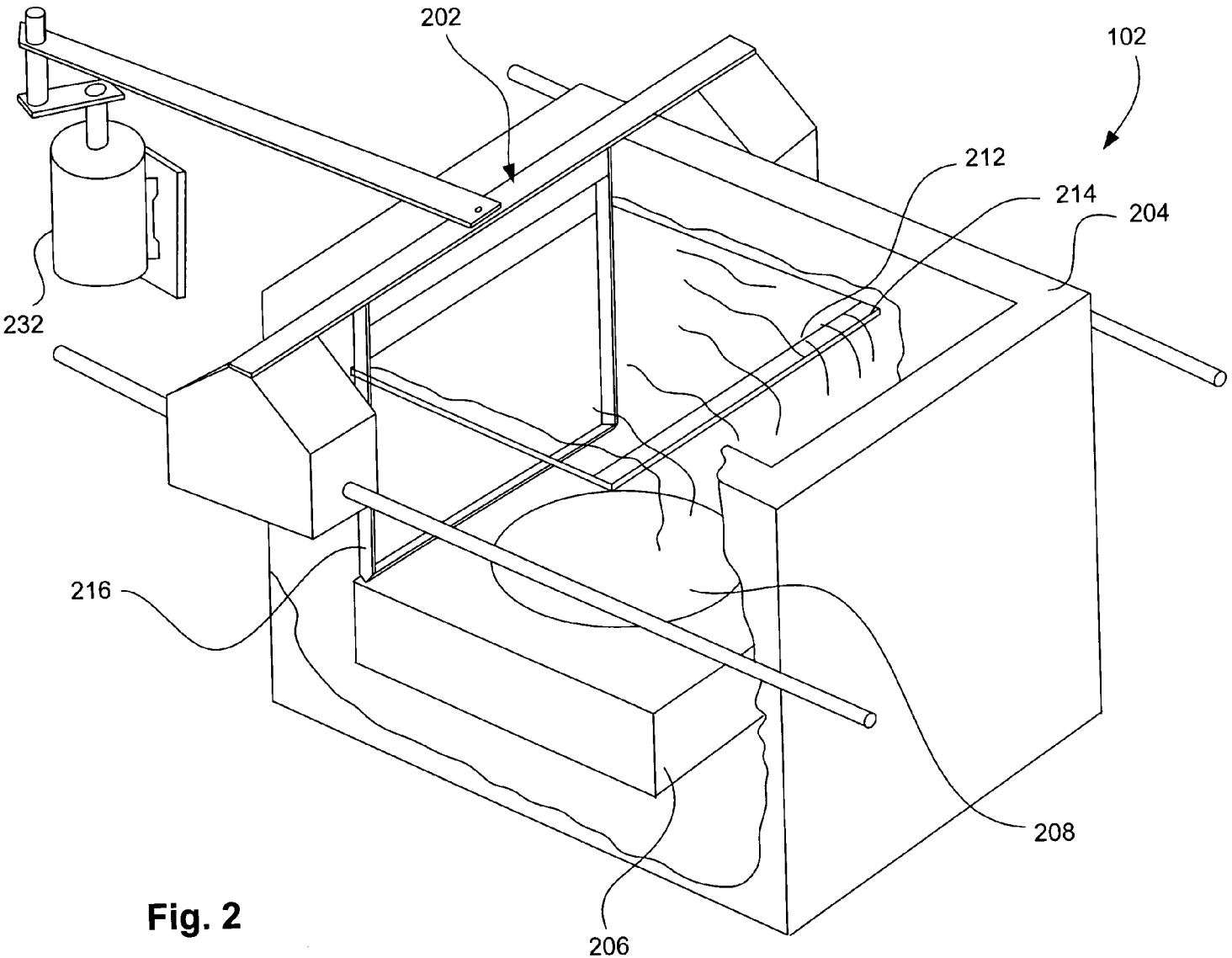
FIG. 2 is a perspective view of a plating cell according to one embodiment.

FIG. 2 depicts an illustrative plating cell 102 having a paddle assembly 202. The plating of nickel-iron alloys is performed in a container 204. The walls of the container 204 can be composed of a dielectric material such as glass or a plastic such as polymethacrylate. Positioned in the container 204 is a cathode 206. The cathode 206 may be composed of a metal plate having plater's tape composed of an insoluble polymer adhesively secured to the exterior thereof on the edges and lower surface to protect it from the electroplating bath and thus giving a very well defined current density and current density distribution. A substrate 208 to be plated is positioned in a depression 210 (FIG. 3) in the cathode 206. Note that the term "substrate" as used herein may be a clean base upon which material is deposited, or can be a previously/partially formed wafer. Substrate materials may include, for example, 1¼ inch diameter sapphire, garnet, various ceramics or Si wafers covered with thermal $SiO_2$ and metallized with 50A to 100A of Ti and 100A to 1000A of Cu, Permalloy alloy, Au, etc.

An anode 212 is also positioned in the container 204 and may be composed of wire mesh screening. The anode 212 may also be composed of inert platinum, solid nickel or of a combination of an inert Pt sheet and a Ni wire mesh.

The plating solution in the bath may be any combination of Ni, Co, Fe, or any other material. The bath level during plating is above the anode 212, so the anode 212 is immersed in the bath during plating. The bath level is held relatively constant by a solution overflow 214 over which the solution flows. The bath is constantly replenished and its temperature is controlled by recirculation from a reservoir (not shown) where it is refreshed by dispensing acid, iron and preferably also Na Saccharin, Na lauryl sulfate and/or [$Ni^{++}$] if needed and constantly stirred by a reciprocating mixer 216 otherwise referred to herein as a paddle 216, which travels back and forth above the surface of cathode 206 at an approximate distance of 1/32 to 1/8 inch for providing agitation of the bath, preferably with minimal turbulence.

Figure 3:
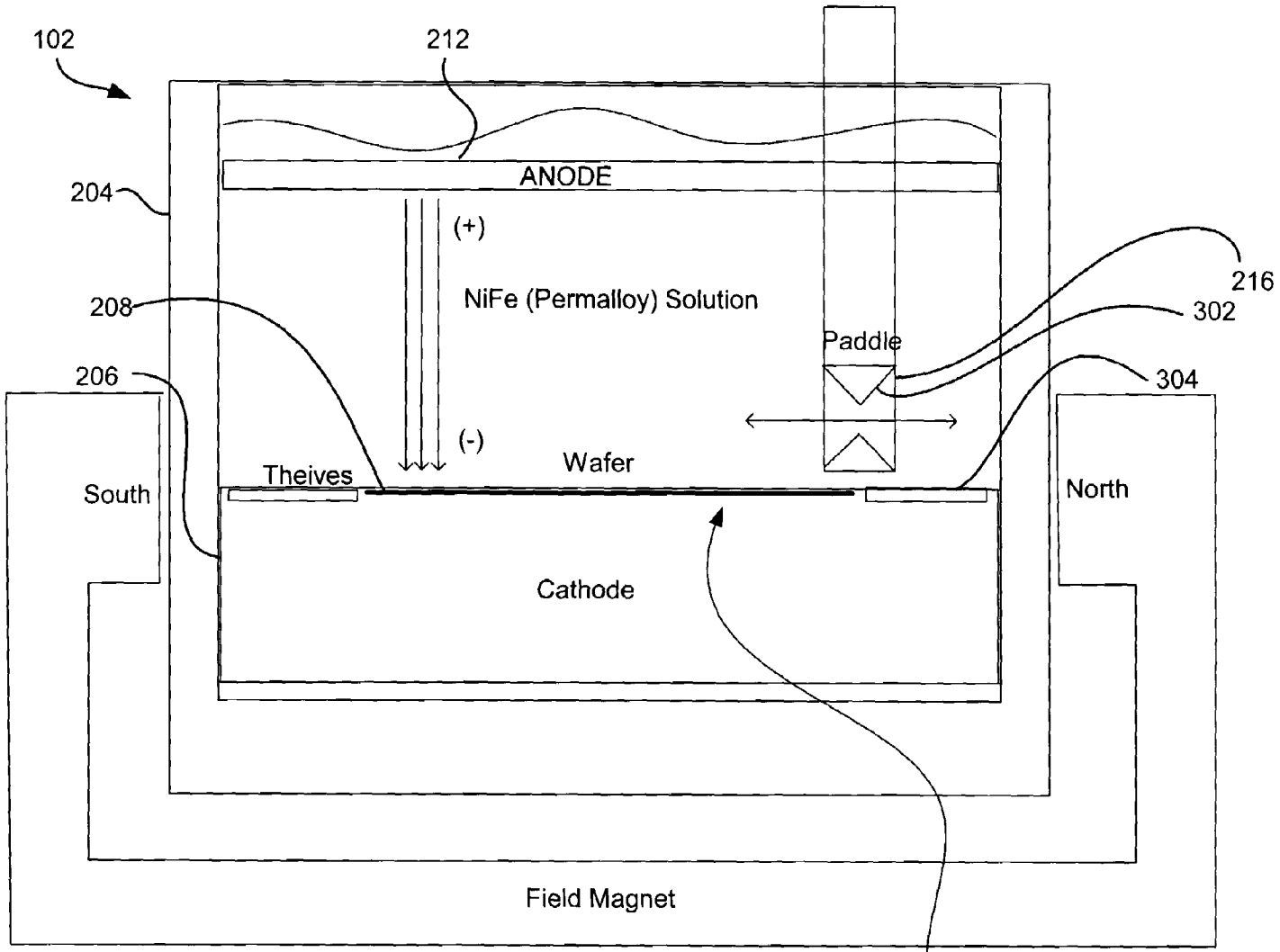
FIG. 3 is a cross sectional view of a plating cell according to one embodiment.

As shown in FIG. 3, the paddle 216 in this exemplary embodiment is in the exemplary form of a pair of vertically elongate, triangular (45°-90°-45°) blades 302 having spaced apart, parallel apexes defining therebetween a slot through which the fluid is flowable. The blades 302 of the paddle 216 have oppositely facing, parallel, flat bases with one of the bases being disposed parallel to and closely adjacent to the substrate 208.

Preferably, the paddle travels at a constant velocity over the object being plated to provide the most uniform film deposition. Thus, a programmable motor can be used, such as a rotary motor with a worm screw, or a linear conversion actuator. These mechanisms provide a generally trapezoidal velocity profile. Consequently, layers of films produced in the electroplating cell of this embodiment are uniformly thick throughout, and where metal alloys are being plated, the metal compositions of particular layers will also be uniform over the entire film.

Referring again to FIGS. 2 and 3, when the motor 232 is energized, the paddle 216 is driven back and forth over the length of the substrate 208, with acceleration and deceleration preferably occurring over thieves 304, also known as deflectors, on the cathode 206.

The speed of the cycle (one pass of the paddle 216 forward and back) can be changed by varying the rotation speed of the motor 232.

Using equipment such as that shown in FIGS. 1–3 for electrodeposition (electroplating), multiple layers of magnetic materials with varying composition can be deposited from a single plating bath by changing the deposition conditions. By controlling the plating conditions, the composition of the materials deposited on the substrate can be manipulated to produce alloys of different composition, and hence different magnetic moments. Prior to actual plating, the plating conditions that produce the desired alloy composition are determined experimentally for the particular type of plating equipment being used. These conditions can then be programmed into the controller.

As discussed in detail above, the ferric ion content of plating baths containing iron influences the rate and nature of the metal deposits. Air oxidation of the ferrous iron results in a continuing buildup of ferric ion in the bath.

Referring again to FIG. 1, a metal electrode 112, preferably having at least a platinum surface, is introduced into the bath over which hydrogen is bubbled, according to one embodiment of the present invention. The introduction of this 'hydrogen' electrode into the bath provides a surface on which ferric ions ($Fe^{3+}$) are electrochemically reduced to ferrous ions ($Fe^{2+}$) very efficiently. Preferably, the potential of this surface never gets negative enough to plate out iron, cobalt or nickel, and therefore does not interfere with the other constituents of the bath. By keeping the ferric content under control, the precipitation of ferric hydroxide is avoided, and filters will last almost indefinitely. Also, the current efficiency, and therefore the plating rate of the bath will be more stable and consistent. This scheme also displaces dissolved oxygen to a certain extent, further reducing conversion of ferrous ions to ferric ions.

An expanded (i.e., mesh) titanium metal electrode that is platinized on the surface works very well as the electrode 112 due to its large surface area. It is physically robust, minimizes the cost by minimizing the amount of platinum, and is readily available. A gas sparger 114 can be used to bubble the hydrogen over the electrode 112. Alternatively, hydrogen can be introduced into the bath in general where the natural solubility of hydrogen in aqueous solutions may supply enough for this purpose (depending on the composition of the plating solution, of course). In addition, the electrode 112 can be charged with hydrogen by energizing it as the cathode in a separate circuit with an acceptable sacrificial anode.

The electrode 112 can be placed in the plating cell 102 and/or the plating reservoir 104. Preferred placement is in the plating reservoir 104. As an alternative to using a standalone electrode or in combination therewith, a platinum gauze electrode can be placed in the filter housing 110 or piping, where circulation would be significant. Hydrogen can be sparged into the flow of plating solution ahead of the gauze electrode, and/or can be introduced into the bath in general where the natural solubility of hydrogen in aqueous solutions may supply enough for the purpose.

Figure 4:
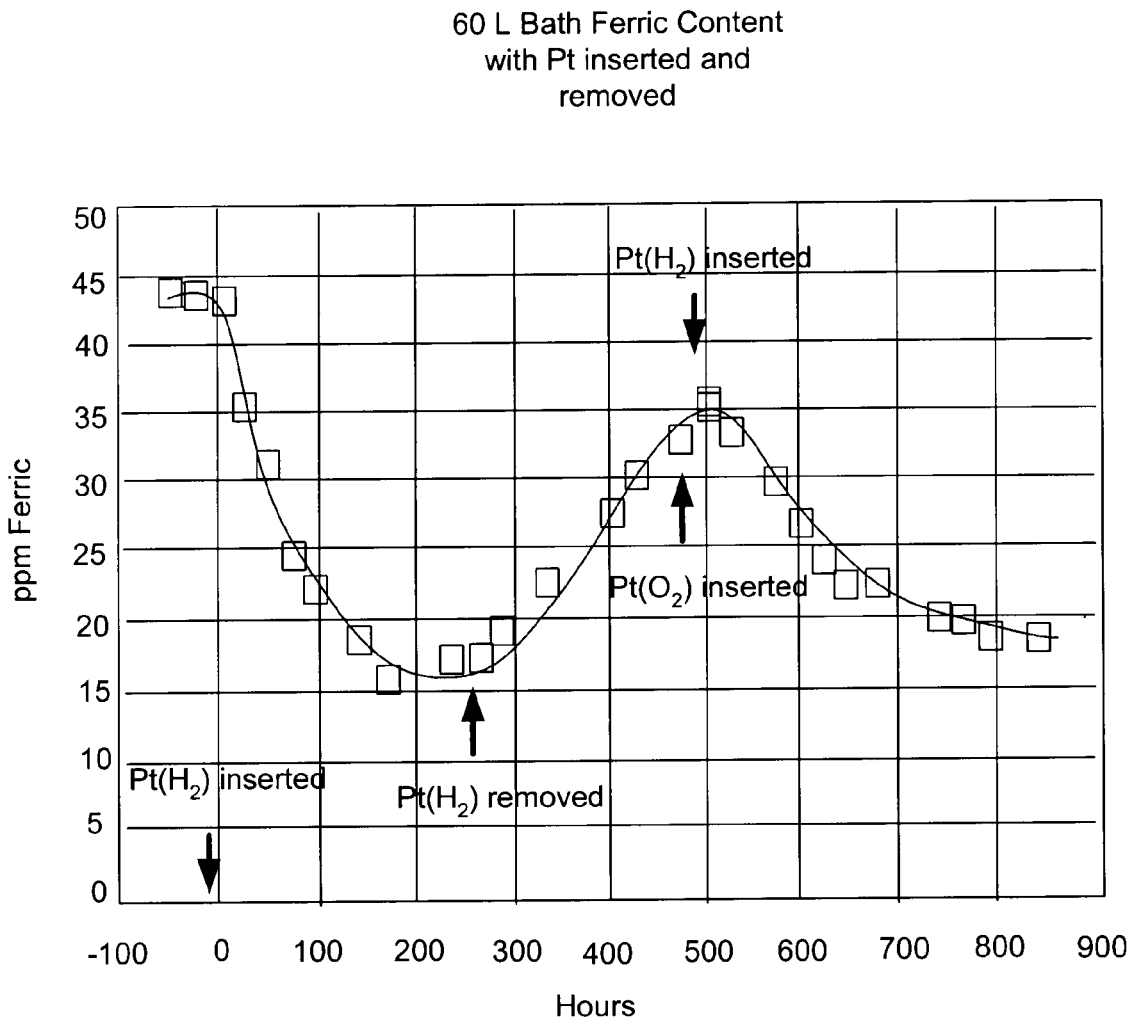
FIG. 4 is a graph depicting the effect of a platinized electrode on the ferric content in a plating solution in the presence of hydrogen.

FIG. 4 graphically illustrates an exemplary effect of a platinized titanium electrode on the ferric content in a plating solution (20/80 NiFe). More particularly, FIG. 4 shows that when hydrogen is introduced over the platinum electrode, the ferric content is reduced, and when the hydrogen is removed or when oxygen is introduced, the ferric content increases. The ferric content was measured spectrophotometrically as the thiocyanate complex during the course of gathering this data.

As shown in FIG. 4, the ferric content at 0 hours is about 45 ppm ferric ions. After insertion of the electrode at 0 hours, the $Fe^{3+}$ in the plating bath is lowered from 45 ppm to about 15 ppm by 175 hours. During the first 50 hours, the ferric change is about 5.8 ppm/day. When hydrogen is introduced from hours 70 to 150, the ferric reduction rate is 2.3 ppm/day.

At 250 hours, the hydrogen supply to the electrode is removed, and consequently, the ferric content increases. During hours 250 to 450, the rate of ferric production is estimated as approximately 1.7 ppm/day, due to the air oxidation of ferrous ions during the normal circulation of the bath. At 450 hours, oxygen is bubbled over the electrode to raise the ferric content. At 500 hours, the electrode is reintroduced with hydrogen, and again the ferric content decreases over time. From 500 to 650 hours, the ferric reduction rate is at about 2.4 ppm/day, which is close to the results from hours 70 to 150. Eventually, the ferric content levels off between 15 and 20 ppm, where the rate of production and the rate of reduction are the same.

Obtaining lower ferric levels in the bath is possible by increasing the area of the platinum electrode, and/or increasing the circulation of the bath near the electrode.

The methods of ferric control described above are even more useful in baths that have even higher iron content, such as cobalt iron baths. Using the embodiments of the invention disclosed herein, it is possible to control the ferric content to almost any specified level. This is a significant advantage over a system that allows the ferric to drift and seek its saturation level, or that requires periodic chemical intervention.

The inclusion of ferric hydroxide in the plated film is sometimes thought to be the cause of poor electrodeposits, and this problem would also be avoided by the use of this invention.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for reducing ferric ion content in a plating solution, comprising:

exposing hydrogen to an energized electrode in a plating solution for reducing a ferric ion content in the plating solution;

wherein the electrode is present in the plating solution in addition to an anode and a cathode.

2. The method as recited in claim 1, wherein the electrode has a platinum surface.

3. The method as recited in claim 2, wherein the electrode is a platinized titanium electrode.

4. The method as recited in claim 1, wherein the hydrogen is bubbled over the electrode.

5. The method as recited in claim 1, wherein the hydrogen is added to the plating solution, the hydrogen dissolving into the plating solution.

6. The method as recited in claim 1, further comprising increasing a circulation of the plating solution near the electrode.

7. The method as recited in claim 1, wherein the electrode is positioned in a plating reservoir.

8. The method as recited in claim 1, wherein the electrode is positioned in a plating cell.

9. The method as recited in claim 1, wherein the electrode is positioned in a filter housing.

10. A method, comprising:

energizing an electrode positioned in a plating solution;

wherein the electrode has a platinum surface;

wherein the plating solution has a partial iron content; and exposing hydrogen to the electrode;

wherein the electrode is present in the plating solution in addition to an anode and a cathode.

11. The method as recited in claim 10, wherein the hydrogen is bubbled over the electrode.

12. The method as recited in claim 10, wherein the hydrogen is added to the plating solution, the hydrogen dissolving into the plating solution.

13. The method as recited in claim 10, further comprising increasing a circulation of the plating solution near the electrode.

14. The method as recited in claim 10, wherein the electrode is positioned in a plating reservoir.

15. The method as recited in claim 10, wherein the electrode is positioned in a plating cell in the presence of a magnetic field.

16. The method as recited in claim 10, wherein the electrode is positioned in a filter housing.

17. A method for reducing a ferric ion content in a plating solution, comprising:

energizing an electrode constructed of platinized titanium; and exposing hydrogen to the electrode in the presence of a magnetic field for reducing a ferric ion content in the plating solution, wherein the electrode is present in the plating solution in addition to an anode and a cathode.

18. A method for reducing ferric ion content in a plating solution, comprising:

exposing hydrogen to an energized electrode in a plating solution for reducing a ferric ion content in the plating solution;

wherein the electrode is present in the plating solution in addition to an anode and a cathode, wherein the hydrogen is added to the plating solution, the hydrogen dissolving into the plating solution.

19. The method as recited in claim 18, wherein the electrode has a platinum surface.

20. The method as recited in claim 19, wherein the electrode is a platinized titaniun electrode.

21. The method as recited in claim 18, wherein the hydrogen is bubbled over the electrode.

22. The method as recited in claim 18, further comprising increasing a circulation of the plating solution near the electrode.

23. The method as recited in claim 18, wherein the electrode is positioned in at least one of a plating reservoir, a plating cell, and a filter housing.

* * * * *

UNITED STATES PATENT AND TRADEMARK OFFICE

CERTIFICATE OF CORRECTION

PATENT NO. : 7,156,972 B2
APPLICATION NO. : 10/427232
DATED : January 2, 2007
INVENTOR(S) : Diel et al.

It is certified that error appears in the above-identified patent and that said Letters Patent is hereby corrected as shown below:

In the claims:
col. 8, line 15 change “titaniun” to --titanium--.

Signed and Sealed this

Third Day of April, 2007

JON W. DUDAS
*Director of the United States Patent and Trademark Office*